US007334883B2

(12) United States Patent
Campillo et al.

(10) Patent No.: US 7,334,883 B2
(45) Date of Patent: Feb. 26, 2008

(54) PRINTER, PRINTHEAD, APPARATUS AND METHOD FOR AIR-FREE INK DELIVERY

(75) Inventors: Alejandro Campillo, Barcelona (ES); Ezequiel Jordi Rufes, Sant Feliu de Llobregat (ES); Pedro Luis Las Heras, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 286 days.

(21) Appl. No.: 10/925,597

(22) Filed: Aug. 25, 2004

(65) Prior Publication Data

US 2006/0044367 A1 Mar. 2, 2006

(51) Int. Cl.
*B41J 2/175* (2006.01)

(52) U.S. Cl. ..... 347/84; 347/85

(58) Field of Classification Search ..... 347/84, 347/85

See application file for complete search history.

(56) References Cited

U.S. PATENT DOCUMENTS

| | | | | |
|---|---|---|---|---|
| 5,719,608 | A | 2/1998 | Sabonis et al. | 347/85 |
| 5,847,734 | A | 12/1998 | Pawlowski, Jr. | 347/86 |
| 5,877,795 | A | 3/1999 | Gragg et al. | 347/92 |
| 5,984,462 | A | 11/1999 | DeFilippis | 347/86 |
| 6,206,512 | B1 | 3/2001 | Gasso et al. | 347/85 |
| 6,419,343 | B1 | 7/2002 | Taylor et al. | 347/35 |
| 6,481,837 | B1 | 11/2002 | Askren et al. | 347/85 |
| 6,609,780 | B2 * | 8/2003 | Sugiyama | 347/33 |
| 6,638,610 | B1 | 10/2003 | Yao | 420/304.4 |

* cited by examiner

*Primary Examiner*—An H. Do

(57) ABSTRACT

A printer having an ink delivery system with an air purge to ambient. A vent sealing material is disposed in an air vent. The vent sealing material is pervious to air when dry and impervious to air when wetted by the ink. Also, when wet, the vent sealing material forms a seal in the air vent so that the ink delivery system is sealed in an air free and liquid tight manner.

27 Claims, 5 Drawing Sheets

PRINTER, PRINTHEAD, APPARATUS AND METHOD FOR AIR-FREE INK DELIVERY

FIELD OF THE INVENTION

The present invention relates to a printer, a printhead, an apparatus and a method for the delivery of ink to a printhead in an air-free manner.

BACKGROUND OF THE INVENTION

Large format color ink jet printers generally have a printhead carriage which is mounted for reciprocal movement on the printer in a direction orthogonal to the direction of movement of the paper or other medium on which printing is to take place through the printer. The printer carriage of a color printer typically has four removable electric or thermal ink jet printheads mounted thereon. Each of the printheads contains a supply of ink which, for large scale printers, is generally inadequate due to the large volumes of ink which are required as compared with the ink supply requirements of desk top printers. Consequently, various mechanisms have been proposed for continuously or periodically refilling the carriage-borne printheads with ink. These systems fall into two categories. The first system comprises offboard or off-axis ink reservoirs that are continuously connected to the carriage-borne or onboard printheads by flexible tubes. An example of the first system is described in U.S. Pat. No. 6,206,512, which is assigned to the assignee of the present application.

The second system comprises a "take a gulp" system in which the printhead carriage is periodically moved to one end of its path of travel where it is then connected with off-axis ink reservoirs to fill the onboard printheads. This "take a gulp" system is disclosed in Hewleft-Packard's Designjet 2000 printer referred to in U.S. patent application Ser. No. 08/805,861 filed Mar. 3, 1997 and published in European Patent Publication No. 0863016 on Sep. 9, 1998.

Such printers include an ink delivery system that provides an ink flow to the printheads from ink reservoirs. Air entrapped in the ink delivery system can cause print defects. To purge or remove the entrapped air, the prior art has used a separate disposable set up pen. This adds cost in the form of extra parts and has a usability disadvantage because the user needs to install and uninstall two sets of pens (set up pens and real printheads), which often is not a well understood process. Another attempt to solve the problem of purging air has used a hydrophobic material in an air vent disposed in a purge chamber. However, when the printer becomes idle between print jobs, the ink is drained from the ink delivery system. This requires that the ink delivery system be purged after each idle time ends before a new print job can be executed. This is a big disadvantage because air purging in large format printers can require several minutes, which is unacceptable to many users.

Thus, the problem of purging air from an ink delivery system without the aforementioned disadvantages remains unsolved.

SUMMARY OF THE INVENTION

The present invention solves the aforementioned problem by providing a vent sealing material in an air vent of a fluid passageway for the ink. The material is pervious to air when dry during a purge operation. After wetting by the ink, the material becomes impervious to both air and ink, thereby providing a permanent seal to the fluid passageway.

In an embodiment of the apparatus of the present invention, an apparatus provides a fluid passageway that provides a first path for the flow of ink to a printhead. An air vent to ambient is connected to the fluid passageway. A vent sealing material is disposed in the air vent. The vent sealing material, when dry, provides a second path for purging air from the fluid passageway, and when wetted by the ink, seals the air vent, thereby sealing the fluid passageway in an air free and liquid tight manner.

In another embodiment of the apparatus of the present invention, an input port admits the flow of ink to the fluid passageway and an output port provides the flow of ink to the printhead.

In another embodiment of the apparatus of the present invention, the fluid passageway remains sealed and full of ink during idle time between print jobs being performed with the printhead.

In another embodiment of the apparatus of the present invention, the vent sealing material is a porous hydrophobic and/or oleophobic material.

In another embodiment of the apparatus of the present invention, the hydrophobic and/or oleophobic material has a surface energy of from about 5 dynes/cm$^2$ to about 30 dynes/cm$^2$ and comprises a porous thermoplastic substrate having a surface at least part of which is coated with a high molecular weight fluorochemical.

In another embodiment of the apparatus of the present invention, the porous thermoplastic substrate is made of a thermoplastic selected from the group consisting of: ethylene vinyl acetate; ethylene methyl acrylate; polyethylenes; polypropylenes; ethylene-propylene rubbers; ethylene-propylene-diene rubbers; poly(1-butene); polystyrene; poly(2-butene); poly(1-pentene); poly(2-pentene); poly(3-methyl-1-pentene); poly(4-methyl-1-pentene); 1,2-poly-1,3-butadiene; 1,4-poly-1,3-butadiene; polyisoprene; polychloroprene; poly(vinyl acetate); poly(vinylidene chloride); and mixtures and derivatives thereof.

In another embodiment of the apparatus of the present invention, the high molecular weight fluorochemical is selected from the group consisting of: fluorinated acrylates, methacrylates, acrylic esters, and mixtures thereof.

In an embodiment of the printer of the present invention, an ink delivery system provides a flow of ink to a printhead. The ink delivery system comprises an ink reservoir in fluid communication with the printhead. An air vent is in fluid communication with the ink reservoir and the printhead. A vent sealing material is disposed in the air vent. The vent sealing material, when dry, provides a path for purging air from the flow of ink, and when wetted by the ink, seals the air vent, thereby sealing the air vent in an air free and liquid tight manner.

In another embodiment of the printer of the present invention, the ink delivery system further comprises a fluid passageway in fluid communication with the ink reservoir and the printhead. The air vent is connected to the fluid passageway.

In another embodiment of the printer of the present invention, the air vent is located proximate to the printhead.

In another embodiment of the printer of the present invention, the fluid passageway comprises an input port that admits the flow of ink to the fluid passageway. An output port provides the flow of ink to the printhead.

In another embodiment of the printer of the present invention, the fluid passageway remains sealed and full of ink during idle time between print jobs being performed by the printer.

In another embodiment of the printer of the present invention, the vent sealing material is a porous hydrophobic and/or oleophobic material.

In another embodiment of the printer of the present invention, the hydrophobic and/or oleophobic material has a surface energy of from about 5 dynes/cm$^2$ to about 30 dynes/cm$^2$ and comprises a porous thermoplastic substrate having a surface at least part of which is coated with a high molecular weight fluorochemical.

In another embodiment of the printer of the present invention, the porous thermoplastic substrate is made of a thermoplastic selected from the group consisting of: ethylene vinyl acetate; ethylene methyl acrylate; polyethylenes; polypropylenes; ethylene-propylene rubbers; ethylene-propylene-diene rubbers; poly(1-butene); polystyrene; poly(2-butene); poly(1-pentene); poly(2-pentene); poly(3-methyl-1-pentene); poly(4-methyl-1-pentene); 1,2-poly-1,3-butadiene; 1,4-poly-1,3-butadiene; polyisoprene; polychloroprene; poly(vinyl acetate); poly(vinylidene chloride); and mixtures and derivatives thereof.

In another embodiment of the printer of the present invention, the high molecular weight fluorochemical is selected from the group consisting of: fluorinated acrylates, methacrylates, acrylic esters, and mixtures thereof.

In an embodiment of the method of the present invention, air is purged from an ink flow in a printer by providing the ink flow in a path that includes an ink reservoir and printhead of the printer. Air is purged from the path to ambient during a purge operation. Thereafter, the path is sealed in an air free and liquid tight manner.

In another embodiment of the method of the present invention, the purging step purges air via an air vent. The sealing step seals the air vent and the path with a vent sealing material that is disposed in the air vent. The vent sealing material is capable of, when dry purging air during the purging step, and when wetted by the ink, sealing the path in an air free and liquid tight manner during the sealing step.

In another embodiment of the method of the present invention, the vent sealing material is a porous hydrophobic and/or oleophobic material.

In another embodiment of the method of the present invention, the hydrophobic and/or oleophobic material has a surface energy of from about 5 dynes/cm$^2$ to about 30 dynes/cm$^2$ and comprises a porous thermoplastic substrate having a surface at least part of which is coated with a high molecular weight fluorochemical.

In another embodiment of the method of the present invention, the porous thermoplastic substrate is made of a thermoplastic selected from the group consisting of: ethylene vinyl acetate; ethylene methyl acrylate; polyethylenes; polypropylenes; ethylene-propylene rubbers; ethylene-propylene-diene rubbers; poly(1-butene); polystyrene; poly(2-butene); poly(1-pentene); poly(2-pentene); poly(3-methyl-1-pentene); poly(4-methyl-1-pentene); 1,2-poly-1,3-butadiene; 1,4-poly-1,3-butadiene; polyisoprene; polychloroprene; poly(vinyl acetate); poly(vinylidene chloride); and mixtures and derivatives thereof.

In another embodiment of the method of the present invention, the high molecular weight fluorochemical is selected from the group consisting of: fluorinated acrylates, methacrylates, acrylic esters, and mixtures thereof.

In an embodiment of the printhead of the present invention, a fluid passageway provides a first path for a flow of ink to a printing device. An air vent to ambient is connected to the fluid passageway. A vent sealing material is disposed in the air vent. The vent sealing material, when dry, provides a second path for purging air from the fluid passageway, and when wetted by the ink, seals the air vent, thereby sealing the fluid passageway in an air free and liquid tight manner.

In another embodiment of the printhead of the present invention, the fluid passageway remains sealed and full of ink during idle time between print jobs being performed with the printhead.

In another embodiment of the printhead of the present invention, the vent sealing material is a porous hydrophobic and/or oleophobic material.

In another embodiment of the printhead of the present invention, the hydrophobic and/or oleophobic material has a surface energy of from about 5 dynes/cm$^2$ to about 30 dynes/cm$^2$ and comprises a porous thermoplastic substrate having a surface at least part of which is coated with a high molecular weight fluorochemical.

In another embodiment of the printhead of the present invention, the porous thermoplastic substrate is made of a thermoplastic selected from the group consisting of: ethylene vinyl acetate; ethylene methyl acrylate; polyethylenes; polypropylenes; ethylene-propylene rubbers; ethylene-propylene-diene rubbers; poly(1-butene); polystyrene; poly(2-butene); poly(1-pentene); poly(2-pentene); poly(3-methyl-1-pentene); poly(4-methyl-1-pentene); 1,2-poly-1,3-butadiene; 1,4-poly-1,3-butadiene; polyisoprene; polychloroprene; poly(vinyl acetate); poly(vinylidene chloride); and mixtures and derivatives thereof.

In another embodiment of the printhead of the present invention, the high molecular weight fluorochemical is selected from the group consisting of: fluorinated acrylates, methacrylates, acrylic esters, and mixtures thereof.

BRIEF DESCRIPTION OF THE DRAWINGS

Other and further objects, advantages and features of the present invention will be understood by reference to the following specification in conjunction with the accompanying drawings, in which like reference characters denote like elements of structure and.

DESCRIPTION OF THE PREFERRED EMBODIMENT

It is contemplated that the printer, apparatus and method of the present invention can be embodied in any off-axis printer. However, by way of example, a printer is described herein that is similar to the printer described in the aforementioned U.S. Pat. No. 6,206,512, the contents of which are hereby incorporated by reference.

Figure 1:
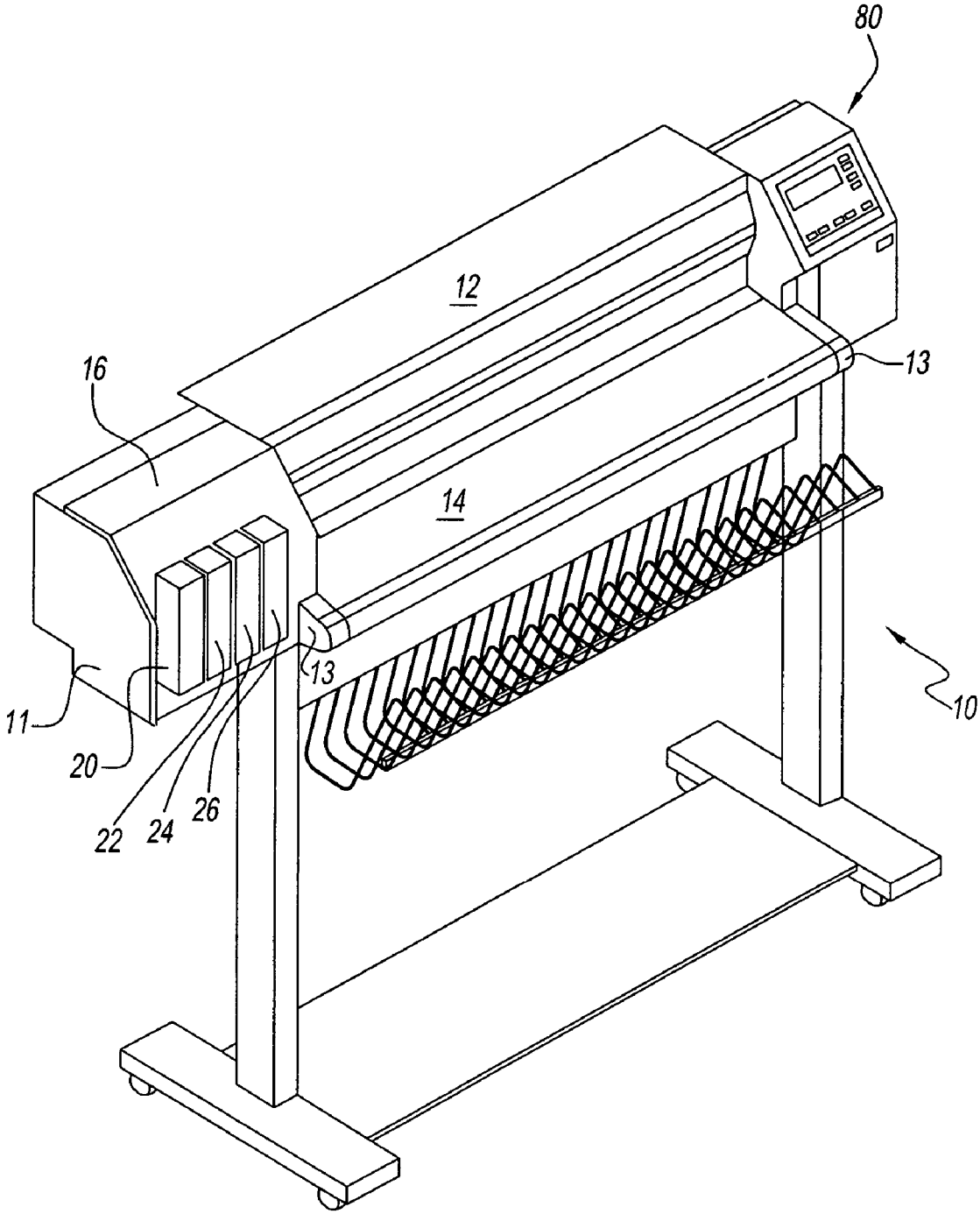
FIG. 1 is a perspective view of a large format printer of the present invention.
Figure 2:
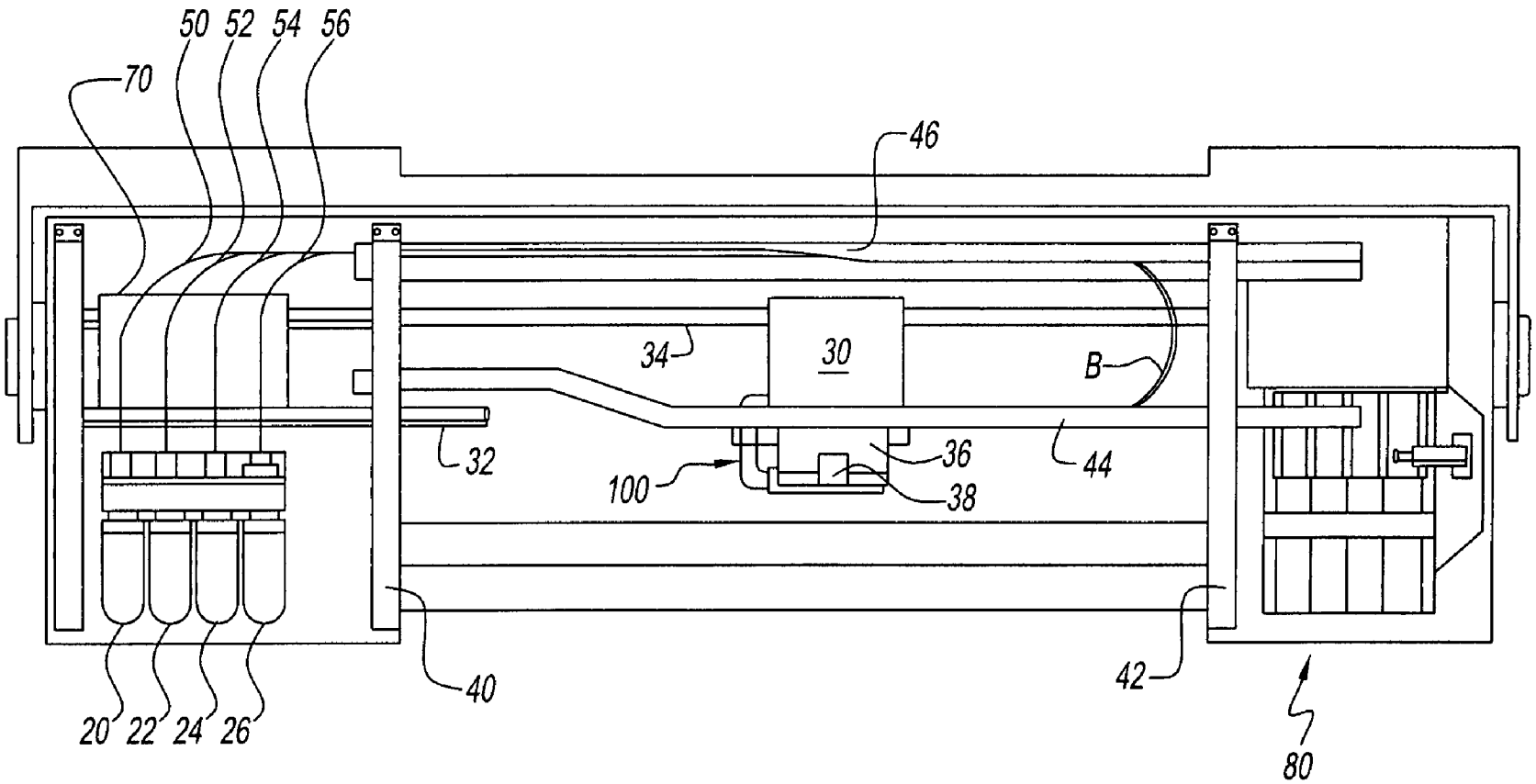
FIG. 2 is a top plan view of the printer of FIG. 1 with its cover removed.

Referring to FIGS. 1 and 2, a large format printer 10 includes a transversely movable printhead carriage 30 enclosed by a plastic or metal hinged cover 12 that extends over a generally horizontally extending platen 14 over which printed media is discharged. At the left side of platen 14 is a reservoir container 11 that includes a transparent hinged cover 16 and that contains four removable ink reservoirs 20, 22, 24 and 26. Reservoir container 11 and platen 14 are mounted to a printer frame 13.

Printhead carriage 30 is mounted on a pair of transversely extending slider rods or guides 32 and 34, which in turn are rigidly affixed to printer frame 13. Also, rigidly affixed to printer frame 13 is a pair of tube guide support bridges 40 and 42 from which front and rear tube guides 44 and 46 are suspended. Printhead carriage 30 has a pivotal printhead holddown cover 36 fastened by a latch 38 at the front side of printer 10 that securely holds one or more inkjet printheads (not shown in FIGS. 1-3). Front tube guide 44 is angled near left bridge support 40 to provide clearance for opening printhead cover 36 when carriage 30 is slid to a position proximate the left side of platen 14 so that printhead holddown cover 36 can be easily opened for changing the printheads. At the right side of the printer is a printhead service station 80 at which the printhead carriage 30 may be parked for servicing such as wiping, spitting or priming the printheads.

Figure 3:
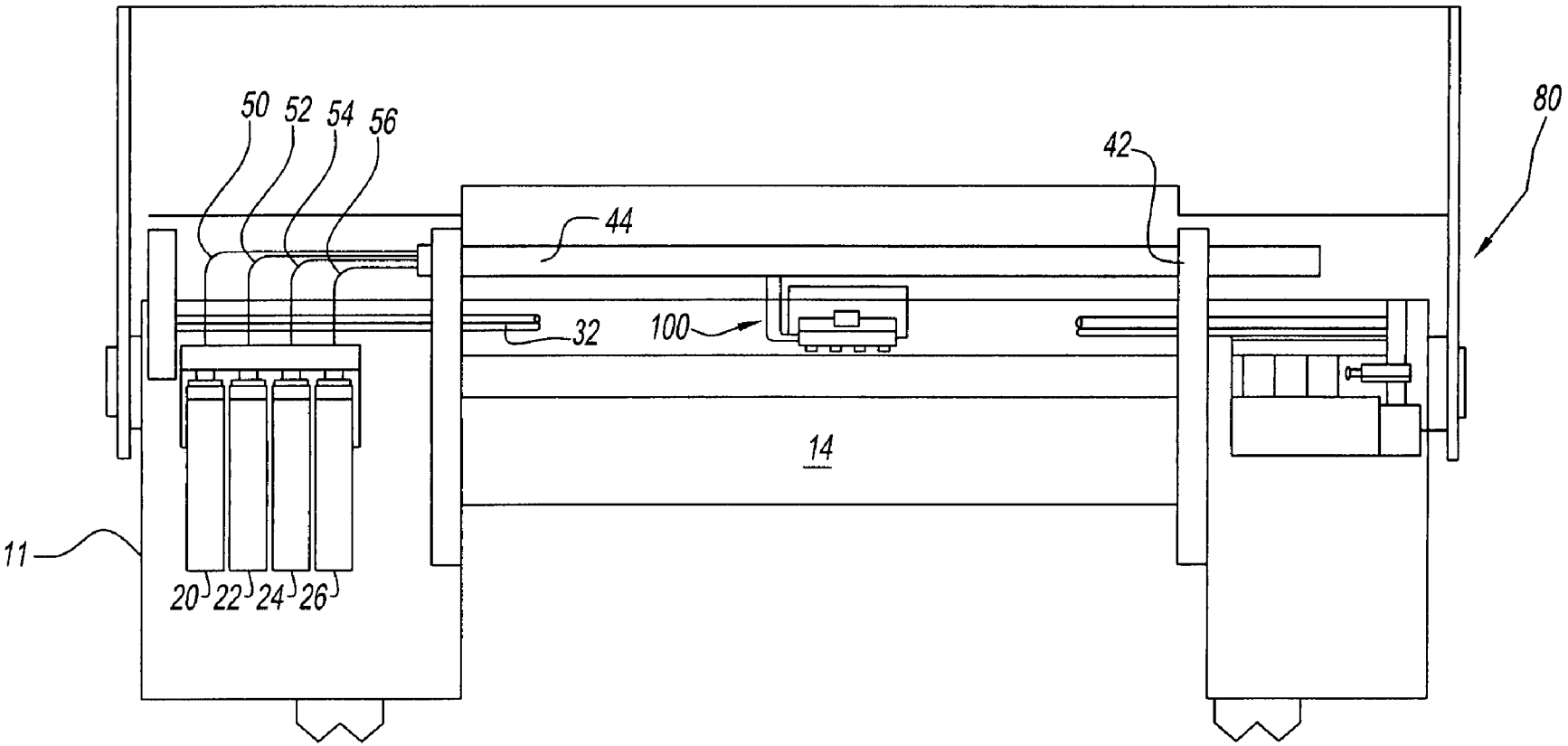
FIG. 3 is a front elevation view of the upper portion of the printer of FIG. 1 with cover removed.

Referring to FIG. 3, ink reservoirs 20, 22, 24 and 26 are each easily accessible from the front of printer 10 when reservoir cover 16 (shown in FIG. 1) is open, so that reservoirs 20, 22, 24 and 26 can be easily removed to be refilled or replaced with new reservoirs. As is known in the art, three of the reservoirs each contain a different base color of ink, such as cyan, magenta and yellow, and the fourth reservoir contains black ink so that a high number of colors can be produced as desired during printing.

Front and rear tube guides 44 and 46 may have a channel configuration with a lower support surface that extends in a common horizontal plane for supporting ink delivery tubes 50, 52, 54 and 56 at all points with the exception of a reverse bend B (FIG. 2) in the tubes to the right of printer carriage 30.

Referring again to FIG. 2, ink reservoirs 20, 22, 24 and 26 are connected via a reservoir connector 70 to ink conduits 50, 52, 54 and 56, respectively. Ink conduits 50, 52, 54 and 56 extend from ink reservoir connector 70 through rear and front tube guides 44 and 46 to a printhead connector 100, which is releasably affixed to the carriage 30.

Figure 4:
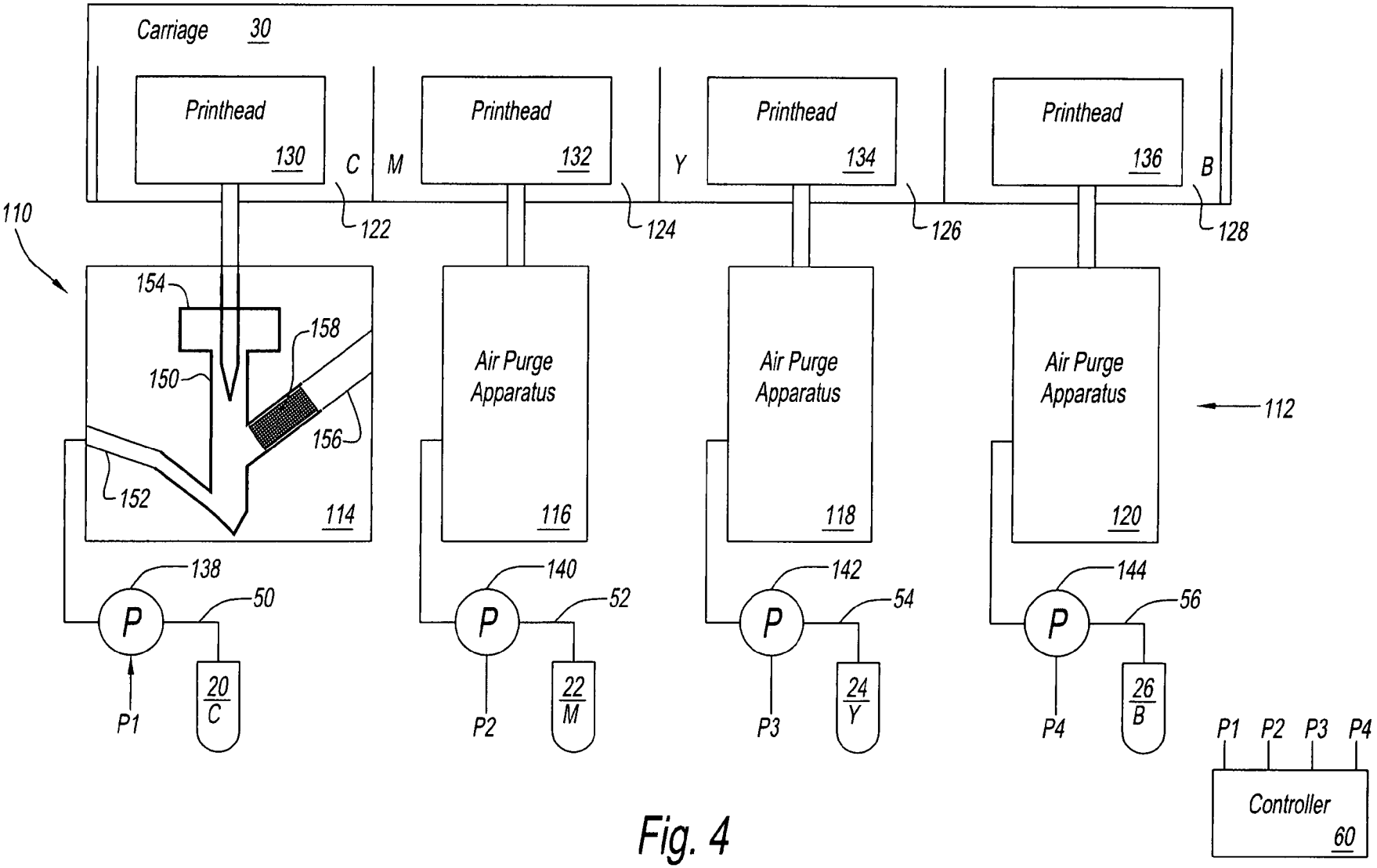
FIG. 4 is a block diagram, in part, and an elevation view, in part, of the printhead carriage and ink delivery apparatus of the printer of FIG. 1.

Referring to FIG. 4, an ink delivery system 110 includes ink reservoirs 20, 22, 24 and 26, ink conduits 50, 52, 54 and 56 and an air purge sub-system 112. Air purge sub-system 112 includes an air purge apparatus 114, an air purge apparatus 116, an air purge apparatus 118 and an air purge apparatus 120 that are in fluid communication with ink reservoirs 20, 22, 24 and 26 via ink conduits 50, 52, 54 and 56, respectively. A plurality of pumps 138, 140, 142 and 140 are disposed in ink conduits 50, 52, 54 and 56, respectively. A controller 60 provides pump control signals P1, P2, P3 and P4 that control pumps 138, 140, 142 and 144, respectively.

Printhead carriage 30 includes a plurality of printhead stalls 122, 124, 126 and 128. A plurality of printheads 130, 132, 134 and 136 are located in printhead stalls 122, 124, 126 and 128, respectively. Printhead stall 130 and ink reservoir 20 are each designated C (cyan); printhead stall 132 and ink reservoir 22 are each designated M (magenta); printhead stall 134 and ink reservoir 24 are each designated Y (yellow); and printhead stall 136 and ink reservoir 26 are each designated B (black).

Thus, ink delivery system 110 comprises a plurality of separate paths for flow of the different colored inks. A first ink flow path for cyan includes ink reservoir 20, pump 138 and air purge apparatus 114. A second ink flow path for magenta includes ink reservoir 22, pump 140 and air purge apparatus 116 and so on.

Air purge apparatus 114, air purge apparatus 116, air purge apparatus 118 and air purge apparatus 120 are substantially identical. Thus, only air purge apparatus 114 will be described in detail. Air purge apparatus 114 includes a fluid passageway 150, an input port 152, an output port 154 and an air vent 156 to ambient. A vent sealing material 158 is disposed in air vent 156. Vent sealing material 158 is pervious to air when dry and impervious to air and ink after being wetted. Vent sealing material 158 may be any suitable material that is pervious to air when dry and impervious to air and ink after being wetted. For example, vent sealing material 158 is preferably a porous hydrophobic and/or oleophobic material, manufactured and sold by Porex Corporation of Fairborn, Ga., and described in U.S. Pat. No. 6,638,610, which is incorporated herein in its entirety. The hydrophobic and/or oleophobic material typically has a surface energy of from about 5 dynes/cm$^2$ to about 30 dynes/cm$^2$ and comprises a porous thermoplastic substrate having a surface at least part of which is coated with a high molecular weight fluorochemical. Preferably, the porous thermoplastic substrate is made of a thermoplastic selected from the group consisting of: ethylene vinyl acetate; ethylene methyl acrylate; polyethylenes; polypropylenes; ethylene-propylene rubbers; ethylene-propylene-diene rubbers; poly(1-butene); polystyrene; poly(2-butene); poly(1-pentene); poly(2-pentene); poly(3-methyl-1-pentene); poly(4-methyl-1-pentene); 1,2-poly-1,3-butadiene; 1,4-poly-1,3-butadiene; polyisoprene; polychloroprene; poly(vinyl acetate); poly(vinylidene chloride); and mixtures and derivatives thereof. The high molecular weight fluorochemical is selected from the group consisting of: fluorinated acrylates, methacrylates, acrylic esters, and mixtures thereof.

During a purge operation, pump 138 is turned on by signal P1. Pump 138 pumps ink from ink reservoir 20 via conduit 50, input port 152, fluid passageway 150 and output port 154 to printhead 130. As ink enters conduit 50, any air in conduit 50 is pushed into fluid passageway 150 and to ambient via air vent 156, vent sealing material 158 being dry at the start of the purge operation. As all the air is expelled, the ink contacts and wets vent sealing material 158. The wetted material plugging 158 seals air vent 156 so that fluid passageway 150 and conduit 50 become air-free and liquid tight. Should the printer 10 become idle, the ink delivery system 10 remains sealed and full of ink, air-free and liquid tight due to the ink continuously wetting vent sealing material 158.

Air vent 156 may be positioned at any suitable location in air purge apparatus 114. Preferably, air vent 156 is positioned at a location that is higher than the lowest point of fluid passageway 150. For example, air vent 156 is preferably positioned just below output port 154.

Figure 5:
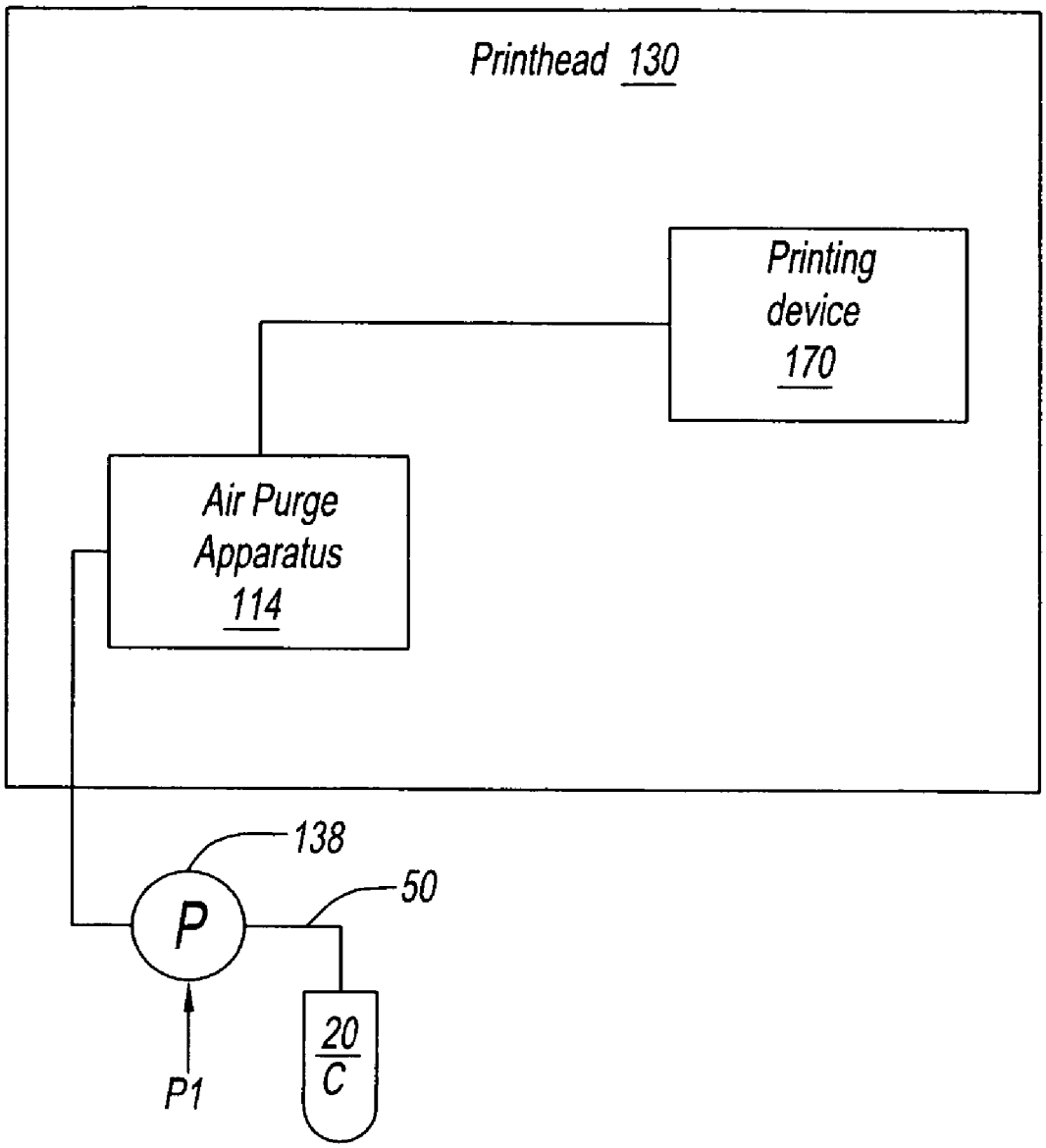
FIG. 5 is a block diagram of a printhead of the present invention.

When printer 10 is shut down, the system stays full of ink as it is completely sealed. At start up, printhead 130 is initialized by introducing ink under pressure from ink reservoir 20 into conduit 50 until the ink fills conduit 50. Air is vented out of conduit 50 as ink fills conduit 50. Once conduit 50 is full of ink, there is a permanent fluidic connection between pump 138 and printhead 130. When ink is required in printhead 130 (while printing or servicing), pump 138 pressurizes conduit 50 and ink flows toward printhead 130, as required. When printer 10 is idle, the system is depressurized. A check valve (not shown) is in ink reservoir 20 so as to prevent ink from returning so that conduit 50 stays full of ink. The operation of pump 138 is well known. For example, the operation of pump 138 is described in U.S. Pat. No. 5,847,734, which is incorporated herein by reference in its entirety Referring to FIG. 5, printhead 130 is shown as integrally including air purge apparatus 114 and a printing device 170. As in FIG. 4, air purge apparatus 114 is connected via pump 138 and conduit 50 to ink reservoir 20. The output of air purge apparatus is connected in a fluid manner to printing device 170 so as to provide an ink flow to printing device via fluid passage way 150 (shown in FIG. 4). Printing device 170 may be any suitable printing device that employs ink for printing. For example, printing device 170 may include ductwork for the ink, a controllable ink ejector and one or more nozzles.

The present invention having been thus described with particular reference to the preferred forms thereof, it will be obvious that various changes and modifications may be made therein without departing from the spirit and scope of the present invention as defined in the appended claims.

What is claimed is:

1. An apparatus for providing a flow of ink to a printhead comprising: a fluid passageway that provides a first path for said flow of ink; an air vent to ambient connected to said fluid passageway; and a vent sealing material disposed in said air vent; wherein said vent sealing material, when dry, purges air from said fluid passageway, and when wetted by said ink, seals said air vent and said fluid passageway in an air free and liquid tight manner, wherein said fluid passageway is sealed and full of ink during idle time between print jobs being performed with said printhead.

2. The apparatus of claim 1, further comprising: an input port that admits said flow of ink to said fluid passageway and an output port that provides said flow of ink to said printhead.

3. The apparatus of claim 1, wherein said vent sealing material is a porous hydrophobic and/or oleophobic material.

4. The apparatus of claim 3, wherein said hydrophobic and/or oleophobic material has a surface energy of from about 5 dynes/cm$^2$ to about 30dynes/cm$^2$ and comprises a porous thermoplastic substrate having a surface at least part of which is coated with a high molecular weight fluorochemical.

5. The apparatus of claim 4, wherein said porous thermoplastic substrate is made of a thermoplastic selected from the group consisting of: ethylene vinyl acetate; ethylene methyl acrylate; polyethylenes; polypropylenes; ethylene-propylene rubbers; ethylene-propylene-diene rubbers; poly(1-butene); polystyrene; poly(2-butene); poly(1-pentene); poly (2-pentene); poly(3-methyl-1-pentene); poly(4-methyl-1-pentene); 1,2-poly-1,3-butadiene; 1,4-poly-1,3-butadiene; polyisoprene; polychloroprene; poly(vinyl acetate); poly(vinylidene chloride); and mixtures and derivatives thereof.

6. The apparatus of claim 4, wherein said high molecular weight fluorochemical is selected from the group consisting of: fluorinated acrylates, methacrylates, acrylic esters, and mixtures thereof.

7. The apparatus of claim 1, wherein said printhead is not ejecting ink during said idle times.) A printhead for a printer comprising: a printing device; a fluid passageway that provides a path for a flow of ink to said printing device; an air vent to ambient connected to said fluid passageway; and a vent sealing material disposed in said air vent; wherein said vent sealing material, when dry, purges air from said fluid passageway, and when wetted by said ink, seals said air vent and said fluid passageway in an air free and liquid tight manner, wherein said fluid passageway remains sealed and full of ink during idle time between print jobs being performed with said printhead.

8. The printhead of claim 7, wherein said vent sealing material is a porous hydrophobic and/or oleophobic material.

9. The printhead of claim 8, wherein said hydrophobic and/or oleophobic material has a surface energy of from about 5 dynes/cm$^2$ to about 30 dynes/cm$^2$ and comprises a porous thermoplastic substrate having a surface at least part of which is coated with a high molecular weight fluorochemical.

10. The printhead of claim 9, wherein said porous thermoplastic substrate is made of a thermoplastic selected from the group consisting of: ethylene vinyl acetate; ethylene methyl acrylate; polyethylenes; polypropylenes; ethylene-propylene rubbers; ethylene-propylene-diene rubbers; poly (1-butene); polystyrene; poly(2-butene); poly(1-pentene); poly(2-pentene); poly(3-methyl-1-pentene); poly(4-methyl-1-pentene); 1,2-poly-1,3-butadiene; 1,4-poly-1,3-butadiene polyisoprene; polychloroprene; poly(vinyl acetate); poly(vinylidene chloride); and mixtures and derivatives thereof.

11. The apparatus of claim 9, wherein said high molecular weight fluorochemical is selected from the group consisting of: fluorinated acrylates, methacrylates, acrylic esters, and mixtures thereof.

12. The printhead of claim 9, wherein said printhead is not ejecting ink during said idle times.

13. The apparatus of claim 1, wherein said printhead is not ejecting ink during said idle times.

14. A printer comprising: a printhead and an ink delivery system that provides a flow of ink to said printhead, wherein said ink delivery system comprises an ink reservoir in fluid communication with said printhead, and an air vent in fluid communication with said ink reservoir and said printhead, a vent sealing material disposed in said air vent; and wherein said vent sealing material, when dry, provides a path for purging air from said flow of ink, and when wetted by said ink, seals said air vent in an air free and liquid tight manner, wherein said ink delivery system further comprises a fluid passageway in fluid communication with said ink reservoir and said printhead, and wherein said air vent is connected to said fluid passageway, wherein said fluid passageway comprises an input port that admits said flow of ink to said fluid passageway and an output port that provides said flow of ink to said printhead, wherein said fluid passageway remains sealed and full of ink during idle time between print jobs being performed by said.

15. The printer of claim 14, wherein said air vent is located proximate to said printhead.

16. The printer of claim 14, wherein said vent sealing material is a porous hydrophobic and/or oleophobic material.

17. The printer of claim 16, wherein said hydrophobic and/or oleophobic material has a surface energy of from about 5 dynes/cm$^2$ to about 30 dynes/cm$^2$ and comprises a porous thermoplastic substrate having a surface at least part of which is coated with a high molecular weight fluorochemical.

18. The printer of claim 17, wherein said porous thermoplastic substrate is made of a thermoplastic selected from the group consisting of: ethylene vinyl acetate; ethylene methyl acrylate; polyethylenes; polypropylenes; ethylene-propylene rubbers; ethylene-propylene-diene rubbers; poly(1-butene); polystyrene; poly(2-butene); poly(1-pentene); poly (2-pentene); poly(3-methyl-1-pentene); poly(4-methyl-1-pentene); 1,2-poly-1,3-butadiene; 1,4-poly-1,3-butadiene; polyisoprene; polychloroprene; poly(vinyl acetate); poly(vinylidene chloride); and mixtures and derivatives thereof.

19. The printer of claim 17, wherein said high molecular weight fluorochemical is selected from the group consisting of: fluorinated acrylates, methacrylates, acrylic esters, and mixtures thereof.

20. The apparatus of claim 14, wherein said printhead is not ejecting ink during said idle times.

21. A method of purging air from an ink flow in a printer comprising: providing said ink flow in a path that includes an ink reservoir and printhead of said printer; purging air from said path to ambient during a purge operation; and sealing said path in an air free and liquid tight manner, wherein said path is sealed and full of ink during idle time between print jobs being performed with said printhead.

22. The method of claim 21, wherein said purging step purges air via an air vent, wherein said sealing step seals said air vent and said path with a vent sealing material that is disposed in said air vent, said vent sealing material being capable of, when dry purging air during said purging step, and when wetted by said ink, sealing said path in an air free and liquid tight manner during said sealing step.

23. The method of claim 22, wherein said vent sealing material is a porous hydrophobic and/or oleophobic material.

24. The method of claim 23, wherein said hydrophobic and/or oleophobic material has a surface energy of from about 5 dynes/cm$^2$ to about 30 dynes/cm$^2$ and comprises a porous thermoplastic substrate having a surface at least part of which is coated with a high molecular weight fluorochemical.

25. The method of claim 24, wherein said porous thermoplastic substrate is made of a thermoplastic selected from the group consisting of: ethylene vinyl acetate; ethylene methyl acrylate; polyethylenes; polypropylenes; ethylene-propylene rubbers; ethylene-propylene-diene rubbers; poly (1-butene); polystyrene; poly(2-butene); poly(1-pentene); poly(2-pentene); poly(3-methyl-1-pentene); poly(4-methyl-1-pentene); 1,2-poly-1,3-butadiene; 1,4-poly-1,3-butadiene; polyisoprene; polychloroprene; poly(vinyl acetate); poly(vinylidene chloride); and mixtures and derivatives thereof.

26. The method of claim 24, wherein said high molecular weight fluorochemical is selected from the group consisting of: fluorinated acrylates, methacrylates, acrylic esters, and mixtures thereof.

27. The method of claim 21, wherein said printhead is not ejecting ink during said idle times.

* * * * *

UNITED STATES PATENT AND TRADEMARK OFFICE

CERTIFICATE OF CORRECTION

PATENT NO. : 7,334,883 B2
APPLICATION NO. : 10/925597
DATED : February 26, 2008
INVENTOR(S) : Alejandro Campillo et al.

It is certified that error appears in the above-identified patent and that said Letters Patent is hereby corrected as shown below:

In column 1, line 35, delete “Hewleft” and insert -- Hewlett --, therefor.

In column 7, lines 56-57, in Claim 7, delete “The apparatus of claim 1, wherein said printhead is not ejecting ink during said idle times.)” before “A printhead”.

In column 8, lines 17, in Claim 10, after “butadiene” insert -- ; --.

In column 8, lines 46, in Claim 14, after “said” insert -- printer --.

Signed and Sealed this

Twelfth Day of August, 2008

JON W. DUDAS
*Director of the United States Patent and Trademark Office*